US005957120A

United States Patent [19]

Wiseby et al.

[11] Patent Number: 5,957,120

[45] Date of Patent: Sep. 28, 1999

[54] ACCESSORY FOR BOW

[76] Inventors: Arne Dennis Wiseby, Skolgatan 5, S-512 54 Svenljunga; Tony Robert Wiseby, Ljungaskogatan 4, S-512 93 Svenljunga, both of Sweden

[21] Appl. No.: 08/816,158

[22] Filed: Mar. 12, 1997

[30] Foreign Application Priority Data

Jan. 14, 1997 [SE] Sweden ..... 9700070

[51] Int. Cl.[6] ..... F41B 5/14

[52] U.S. Cl. ..... 124/86

[58] Field of Search ..... 124/1, 23.1, 86, 124/88

[56] References Cited

U.S. PATENT DOCUMENTS 4,291,452 9/1981 Whitman et al. ..... 124/23.1 X 5,125,389 6/1992 Paff ..... 124/86

5,425,350 6/1995 Egusquiza ..... 124/86

5,746,192 5/1998 Gissel ..... 124/1

*Primary Examiner*—John A. Ricci

*Attorney, Agent, or Firm*—Fasth Law Offices; Rolf Fasth

[57] ABSTRACT

An accessory (1) for a bow to be used for deflecting the bow and includes a tensioning member (6) that is removably attached to both ends (4, 5) of the bow. A catcher (7) in operative engagement with a cog tooth member (8) is movable into a locking position (SI) with the cog tooth member (8) by a weight (9) when the bow is held in an upright position (I) and is released to be permitted to move relative to the cog tooth member (8) when the bow (2) is held in an opposite upright position and the bow (2) is adapted to be deflected.

10 Claims, 4 Drawing Sheets

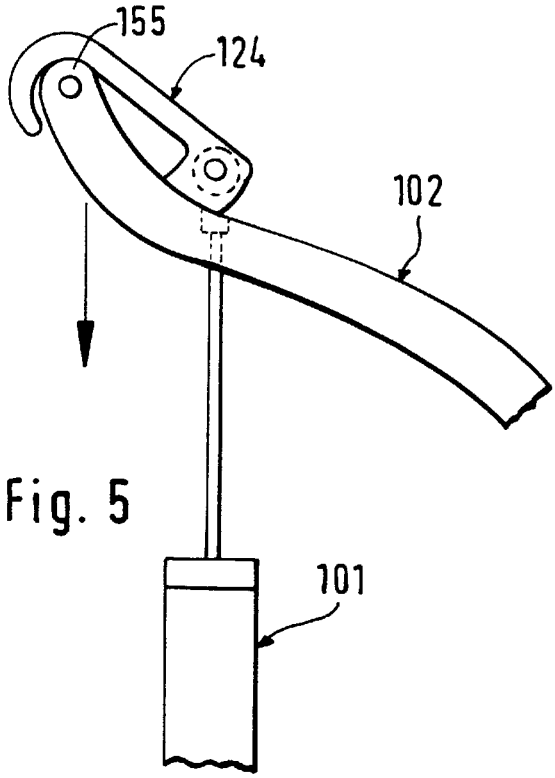
Fig. 5
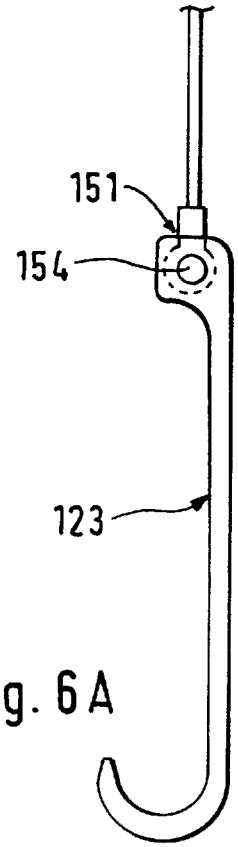
Fig. 6A
Fig. 6B
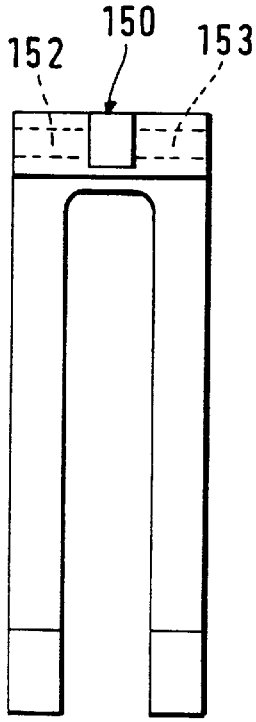

ACCESSORY FOR BOW

TECHNICAL FIELD

The present invention relates to an accessory for a bow to be used to deflect the bow and includes a tensioning device that is releasably attached to both ends of the bow.

BACKGROUND AND SUMMARY OF THE INVENTION

The deflection device for bows of the prior art may be used to, for example, change a bow string on a bow or to perform maintenance of the bow in the field to change the pull length of the wheel of the bow or to adjust the peep, i.e. the sight portion of the bow string. The conventional deflection devices are complicated and of heavy constructions that are not suitable for the shooter to conveniently bring out to the shooting range.

One of the main objects of the present invention is therefore to firstly disclose an apparatus that is simple both regarding the construction and its use.

The object is achieved by the apparatus of the present invention that is mainly characterized by a cogtooth path that cooperates with a catcher. This apparatus is movable into a catching position in cooperation with the cogtooth path that is affected by a weight when the bow is held in an upright position and is released and permitted to move relative the cogtooth path when the bow is held in an opposite upside down position so that the bow may be deflected.

BRIEF DESCRIPTION OF THE DRAWINGS

A preferred embodiment of the present invention is described below with reference to the attached drawings of which:

FIG. 5 shows one end neck of the bow including divided flaps to which the bow deflection device is held with a suitable fastening hook as seen from the side, FIG. 6*a* shows a front view of the hook, FIG. 6*b* shows a side view of the hook.

DETAILED DESCRIPTION OF PREFERRED EMBODIMENTS

Figure 4:
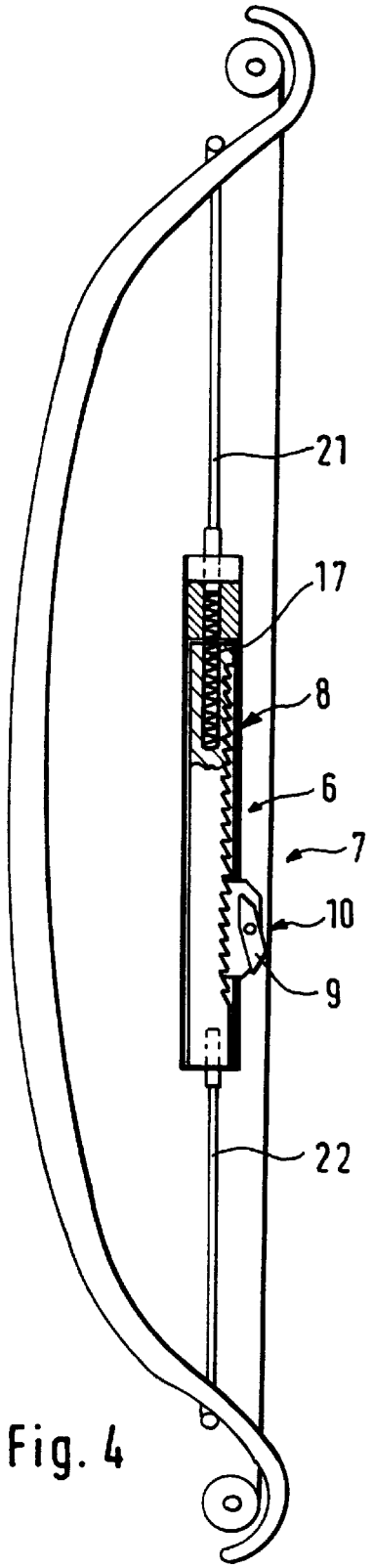
FIG. 4 shows the bow deflection device in an opposite released position on the bow.

A suitable accessory 1 is adapted to be used in connection with a bow 2 to compress the bow 2 to permit work on the bow 2 or string 3. The accessory includes a catching device or catcher 7 and a tensioning device 6 that is releasably attached to both ends 4, 5 of the bow. More particularly, the catching device 7 is cooperating with a cog tooth member 8. The catching device 7 is movable into a locking position SI on the cog tooth member 8 by a weight 9 when the bow 2 is held in an upright position I. When the bow 2 is held in an opposite upright position II, as shown in FIG. 4, the catcher 7 is disengaged and permitted to be moved relative the cog tooth member 8 while it is possible to deflect or bend together the bow 2. The catcher 7 and the weight 9 are formed by a common double swing arm 10 that is rotatably attached to a rotational member 11 that is disposed at a distance from the ends thereof. One end 10A of the swing arm 10 cooperates with the cog tooth member 8 and the other end 10B of the swing arm 10 forms the weight 9. In this way, the end 10A is formed to fit into cog openings 12 of the cog tooth member 8 that are defined in the swing arm of the catchable bow deflection device. The cog openings 12 are formed by a plurality of cavities 12 that are lined up in a row that are separated by teeth 13. Preferably, the cavities 12 and the teeth 13 are triangular shaped and slope in a direction A against one end 8A of the cog tooth member. More particularly, the cog tooth member 8 is saw tooth shaped having pointed ends 14 of the teeth 13 sloping and turned towards the upright end 2A of the bow 2 when the bow 2 and the catcher 7 are held in the upright position with the catcher is in an engaged position.

The lockable swing arm 10 is rotatably attached at the side of a receiving channel 15 that is adapted to receive an elongate blade and rod shaped pullable member 16. The cog tooth member 8 extends along one side 16A of the member 16 that is turned towards the swing arm 10.

The receiving channel 15 of the deflection device and the tensionable member 16 are adapted to be moved relative to one another. In the example shown, the member 16B is movable within the channel 15.

A spring 17 is disposed between the receiving channel 15 and the member 16. Preferably, a pulling spring 17 is disposed to operate between a fastener 18 disposed at one end portion 19 of the receiving channel and the fastening portion 20 of the pullable member 16.

Strings 21, 22 having bow fastening members 23, 24 extend between the end portion 19 and the free end 16B of the pullable member 16. The bow fastening members 23, 24 shown are T-shaped to permit being attached to cavities of the bow 2 that are suitably formed to receive the fastening members.

The second embodiment of the bow fastening mechanism 123, 124, shown in FIGS. 5 and 6, are formed by hooks that are suitable for the bow 102 and include separated flaps. The hooks 123 and 124 are double having a recess 150 defined therebetween in which a cord fastener 151 is receivable and is held to a fastening axle 154 disposed in the openings 152, 153. In this way, the hooks 123, 124 can be hooked about a wheel or other end portions 155 of both ends of the bow.

The function of the bow deflection device 101 is the same as the bow deflection device 1 described above.

Figure 1:
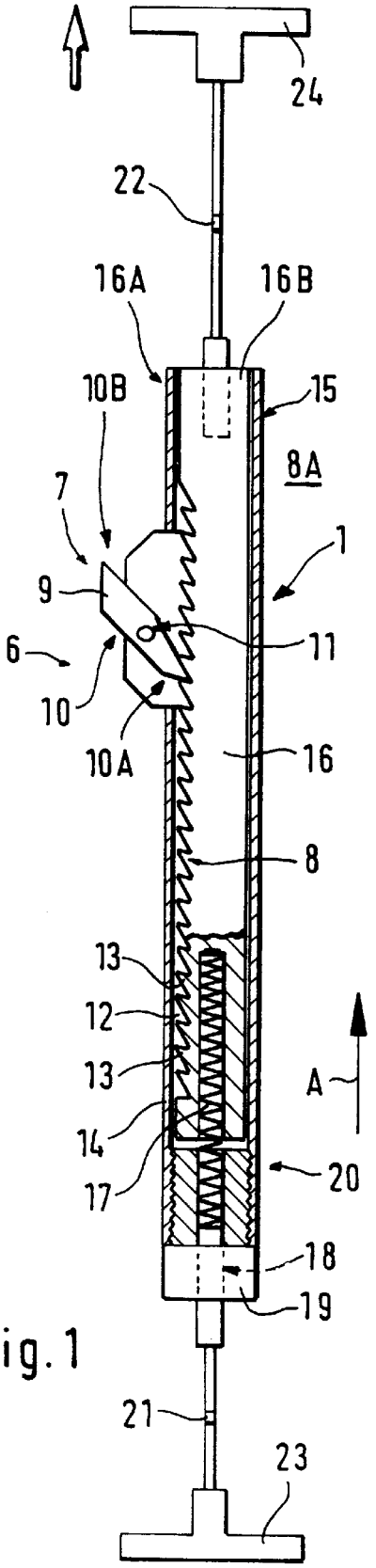
FIG. 1 shows a cross sectional view of a bow deflection device that is in an operational position.
Figure 2:
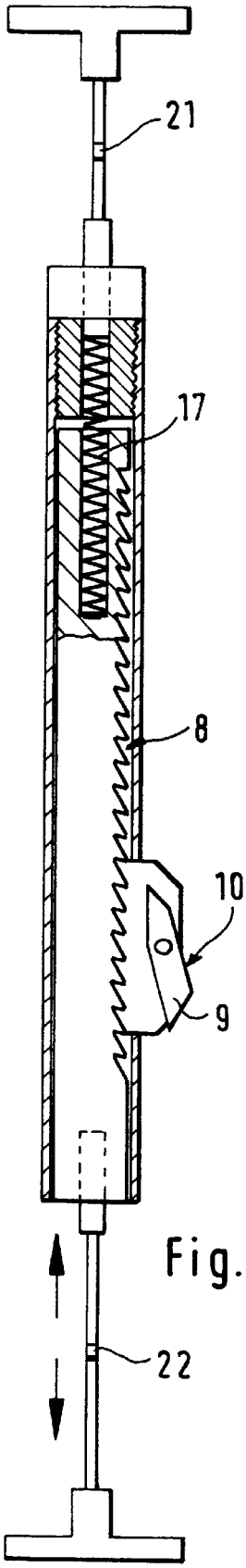
FIG. 2 shows the bow deflection device in an opposite released position.
Figure 3:
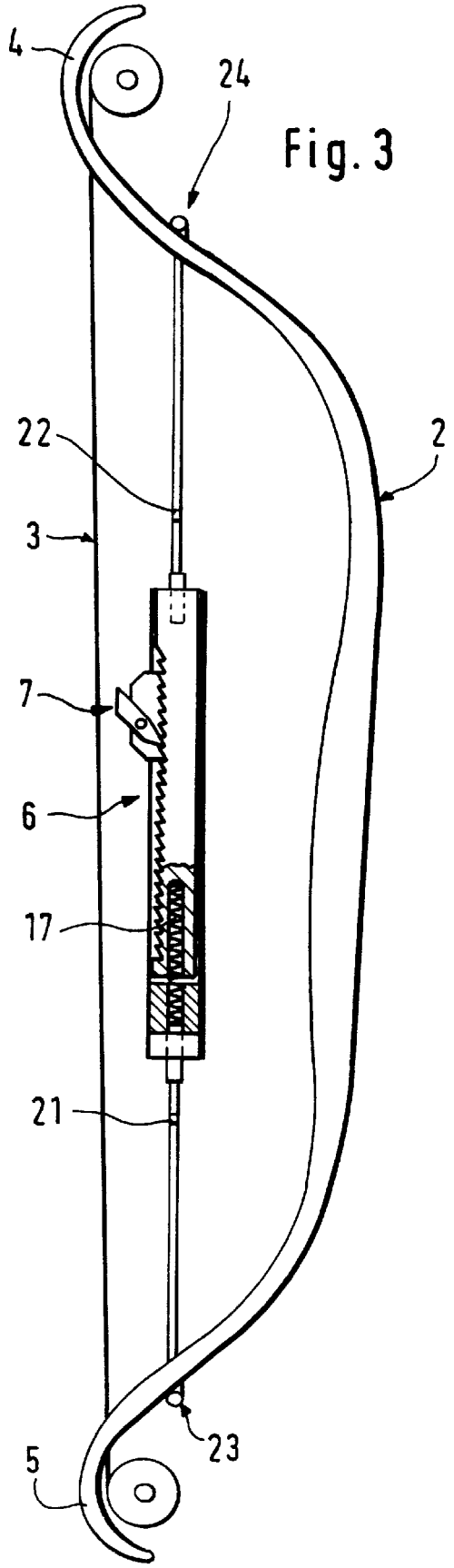
FIG. 3 shows the bow deflection device in an operational position on a bow.

The function of the invention should be understood by the construction of the bow tensioning mechanism. However, in short, it may be mentioned that the locking is performed when the bow 2 is held in the upright position so that the catcher 7 and the leverage arm 10 automatically swing into the locking member 10A into contact with the lockable cog tooth member 8 and the deflection of the bow 2 may be accomplished when the bow is forced to deflect. The catcher 7 is permitted to move over teeth 13 of the cog tooth member 8. When the bow 2 is turned around 180°, as is shown in FIGS. 2 and 4, the bow tensioner 1 may be released by the catcher 7 from the bow 2. This function may be easier to understand from the following instruction:

The bow tensioner is pulled apart and applied to the adapted fastening device of the bow flaps of the bow. When this is done, the bow string of the bow is pulled in the same way as when shooting an arrow. In this way, the bow flaps are pressed together and the bow tensioner locks the bow flaps into a desirable position when the user stops pulling the string (this is principally done in a continuous manner). It is thus possible to determine exactly how much to deflect the bow flaps. To disengage the bow tensioner, the bow is turned upside down and the bow string is pulled. By pulling the bow string, the catcher is released and falls backwardly due to gravity. The bow tensioner is then removed from the bow and everything is ready.

Figure 7A:
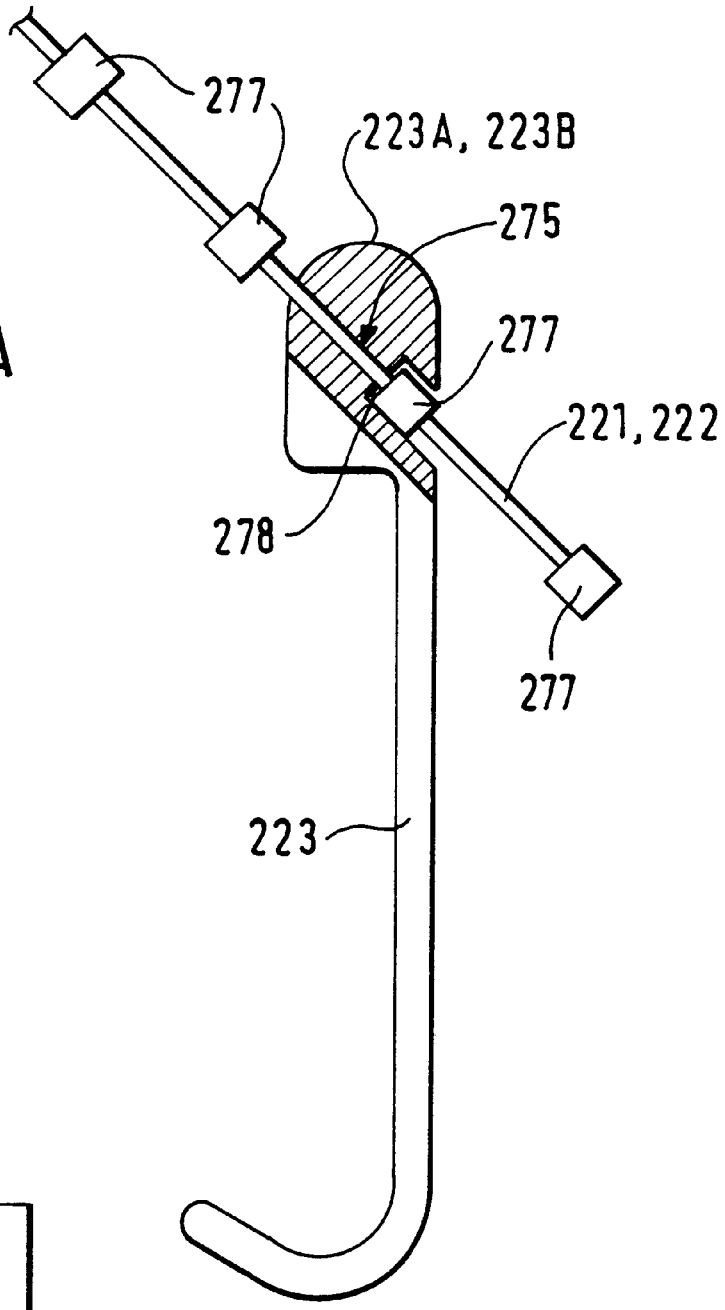
FIG. 7*a* shows a cross sectional view of an alternative embodiment of a hook attachment mechanism for a hook of a bow string.
Figure 7B:
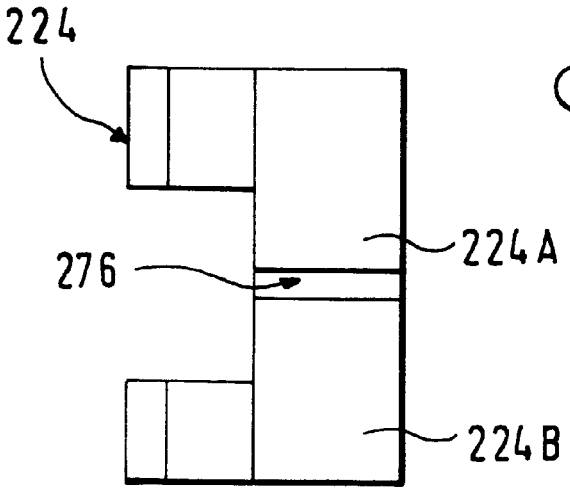
FIG. 7*b* shows a top view of yet an alternative embodiment of a wire attachment mechanism.

An alternative embodiment of a hook attachment mechanism of a string is shown in FIGS. 7*a* and 7*b*. The accessory according to the present invention is adapted for a bow to be attached to the above described bow deflection device, or another known bow deflection device, and to the bow itself. The bow should be of the type that has divided flap portions.

The hooks 223, 224 that are shown each has a receiving groove 275, 276 to receive strings 221, 222, respectively, that are attached to the deflection device. The grooves 275, 276 have a width that is different from a width of a portion 277 of the strings 221, 222 disposed along the length of the strings so that the strings 221, 222 can be held within the grooves 275, 276 and are prevented from being pulled out the grooves along the longitudinal axis of the strings. The portion 277 is an enlarged portion that is attached to the strings 221, 222.

Preferably, the portion 277 may be made of metal or any other durable material and be pressed onto the strings 221, 222. For example, the portion may be a cylindrical shaped or spherical shaped body that prevents the strings from being slidably passed a certain position.

Because different bows have different lengths, it is necessary to be able to attach the deflecting device to a wide variety of bows in a simple and effortless manner. Therefore, a plurality of portions 277 may be disposed on the strings 221, 222 at a certain distance from one another so that a suitable deflection may be achieved by placing the right portion 277 into the cavity 278 defined in the hooks 223, 224.

The groove 275, 276 is centrally disposed between two hook portions 223A, 223B; 224A, 224B of one or both hooks 223, 224, respectively. Preferably, one of the strings 221, 222 is permanently attached to a hook so that only one of the hooks has the above described string attachment device.

When a shorter bow is to be deflected it is necessary to use one of the enlarged portions 277 that are disposed further in on the string as seen from the free end of the string compared to deflecting a bow that is longer.

The present invention is not limited to the above description and the embodiments shown in the drawings. The invention may be varied within the scope of the patent claims without departing from the spirit of the invention.

We claim:

1. An accessory for a bow having opposite end portions, comprising:

a tension mechanism removably attached to the bow to permit a deflection of the bow, the tension mechanism extending between the opposite end portions of the bow;

the tension mechanism having a toothed section;

a catching device adapted to be in operative engagement with the toothed section, the catching device being movable between a locked position so that the catching device is locked to the toothed section and a released position so that the catching device is movable relative to the toothed section; and a weight portion integral with the catching device, the weight portion being adapted to urge the catching device into the locked position when the bow is in a first upright position and to urge the catching device into the released position to permit movement of the catching device relative to the toothed section and to permit deflection of the bow when the bow is in a second upright position, the second upright position being opposite to the first upright position.

2. The accessory according to claim 1 wherein the catching device and the weight portion form a swing arm, the swing arm has a first end that is adapted to engage the toothed section and a second opposite end that is adjacent the weight portion.

3. The accessory according to claim 2 wherein the toothed section has a plurality of cavities formed therein and the first end of the swing arm is adapted to fit into the cavities to lock the tension mechanism.

4. The accessory according to claim 2 wherein the swing arm is rotatably attached to a side portion of an elongate member having a receiving channel defined therein.

5. The accessory according to claim 4 wherein the receiving channel is permitted to receive an elongate blade device, the elongate blade device is adapted to be under tension and the toothed section is disposed along one side of the elongate blade device and is facing the swing arm.

6. The accessory according to claim 5 wherein the elongate blade device disposed in the receiving channel is movable relative to the elongate member.

7. The accessory according to claim 5 wherein a spring is in operative engagement between the elongate blade device and the elongate member.

8. The accessory according to claim 7 wherein the spring is a pulling spring that is operatively disposed between a fastener section located at one end of the elongate member and a fastener section of the elongate blade device.

9. The accessory according to claim 5 wherein a first string is attached to the elongate blade device and extends outwardly therefrom and a second string is attached to the elongate member and extends outwardly therefrom, a first fastening member is attached to an outer end of the first string and a second fastening member is attached to an outer end of the second string.

10. The accessory according to claim 1 wherein the toothed section is saw tooth shaped having pointed ends extending outwardly and upwardly when the bow is in the first upright position.

* * * * *